United States Patent [19]

Botkin

[11] 4,051,973

[45] Oct. 4, 1977

[54] CANNING CLOSURE AND METHOD

[76] Inventor: Albert L. Botkin, 3018 Hood Ave., Chicago, Ill. 60659

[21] Appl. No.: 691,310

[22] Filed: June 1, 1976

Related U.S. Application Data

[63] Continuation-in-part of Ser. No. 572,160, April 28, 1975, Pat. No. 3,967,746.

[51] Int. Cl.[2] ..... B65D 51/16

[52] U.S. Cl. ..... 215/260; 215/271; 426/131; 426/407

[58] Field of Search ..... 215/260, 262, 270, 271; 220/203, 209; 426/118, 131, 395, 407

[56] References Cited

U.S. PATENT DOCUMENTS

| | | | |
|---|---|---|---|
| 2,046,227 | 6/1936 | White | 215/262 |
| 3,160,302 | 12/1964 | Chaplin | 215/271 |
| 3,462,037 | 8/1969 | Keller | 215/262 |

FOREIGN PATENT DOCUMENTS

| | | | |
|---|---|---|---|
| 650,829 | 3/1951 | United Kingdom | 215/262 |

*Primary Examiner*—Donald F. Norton
*Attorney, Agent, or Firm*—Dressler, Goldsmith, Clement, Gordon & Shore, Ltd.

[57] ABSTRACT

A one-piece reusable closure for home canning. The closure is adapted for sealing home canning containers, such as "Mason Jars." The closure has a one-piece threaded cap with a bonded annular closed-cell foam gasket at the periphery of a central cover section positioned to seal against the jar lip. The central cover portion is dished outwardly and moves to an inwardly dished configuration when a partial vacuum is developed in the container. When the closure is unscrewed, the central cover section springs with an audible click to the outwardly dished configuration. The closure incorporates a one-way pressure relief mechanism to limit the pressure in the container. The mechanism comprises a resilient sealing member overlying an orifice in the central cover section of the lid. As the container contents are heated, gas pressure in the container will increase and force the resilient sealing member from the orifice. Gases will then be vented through the orifice under the resilient sealing member. However, upon subsequent cooling of the container contents and cessation of pressure generation within the container, the closure and resilient sealing member seals the container to enable a partial vacuum to be formed and then maintained. The closure may be initially fully tightened and need not be further tightened after heating and subsequent cooling of the container to maintain the seal and partial vacuum within the container.

15 Claims, 10 Drawing Figures

CANNING CLOSURE AND METHOD

CROSS-REFERENCE TO RELATED APPLICATION

This application is a continuation-in-part application of my application Ser. No. 572,160, filed Apr. 28, 1975, now U.S. Pat. No. 3,967,746.

BACKGROUND OF THE INVENTION

This invention relates to an improved closure for food containers, and particularly to those used for the home canning of foods, and to a method of canning using that closure.

Many types of containers and closures for the home canning of food products have been developed over the years. For many years, the most prevalent home canning medium in the United States has been the so-called "Mason Jar." Such a medium usually comprises a glass container having a standardized external thread on the periphery of the mouth and a suitable cap or closure assembly. Most recently, a widely used two-piece closure assembly has comprised a dished, disc-shaped central cover panel having an annular gasket formed at its periphery on one surface and a threaded peripheral portion. The threaded peripheral portion has a depending skirt or flange with a suitable thread, cooperable with the glass container thread, and an annular shoulder adapted to overlie the upper periphery of the gasketed central cover panel. The threaded peripheral portion is usually loosely threaded on the container after the central cover panel has been positioned over the mouth and prior to heating. The threaded peripheral portion is usually left loose enough so that, as the contents are heated, venting of gases may take place under the gasket. Thereafter, as the container cools the central cover panel seals against the container lip, following which the threaded peripheral portion is tightened so that when the container is stored, vacuum will be positively maintained. When the cover panel is of the dished type, as the container cools, the panel snaps into an inwardly dished position. Other systems for sealing home canning containers have used separate rubber sealing gaskets or rings, and the like.

All of the various media and methods for sealing home canning containers have one or more drawbacks. Some systems require separate and separable sealing elements, such as rubber gaskets or rings. Other require elaborate positive locking mechanisms. The most commonly used system usually requires the use of an implement to remove the sealed central cover panel from a container. Such removal damages the gasketed central cover panel and therefore requires it to be discarded after a single use.

In my copending parent application Ser. No. 572,160, filed Apr. 28, 1975, an invention is disclosed relating to a one-piece reusable closure for home canning. The closure comprises a threaded lid with a bonded annular closed-cell foam gasket at the periphery of a central portion of the lid for confronting and sealing against a jar lip. To provide a means for gas to escape from the jar during heating in the canning process, the gasket is designed to be compressed by the gas pressure to permit venting of the gas between the jar lip and the gasket. To insure that the gasket will always have a suitable compression capability, special limitor projections extend from the periphery of the central portion of the lid, at spaced intervals, downwardly into the gasket and compress the gasket material against the jar lip to control tightening of the lid on the jar. This leaves circumferentially spaced portions of the gasket between the limitor projections in a less compressed state and therefore capable of further compression by increased gas pressure to provide venting as necessary.

It was then found that limitation of the compression of the gasket can be achieved in other novel ways. In my copending Application Ser. No. 691,564, entitled "Canning Closure and Method" filed concurrently herewith, an invention is disclosed in which other limitor means are provided to prevent overtightening of the closure and over-compression of the gasket material to the point where gases cannot vent therethrough. Preferably such limitor means are formed in the skirt of the closure. In one embodiment, the limitor means comprises a deformed portion of the closure skirt thread providing a threading stop for abutment with a leading portion of the container thread. In another embodiment, a portion of the lower edge of the closure skirt abuts a circumferential flange on the glass container. In either case, the closure is prevented from being screwed further onto the container and thus, the gasket is compressed only to a predetermined extent.

SUMMARY OF THE INVENTION

In accordance with this invention, a one-piece, reusable closure for home canning containers is provided. It effectively seals the container, prevents blow-out of the gasketing material under rapid decompression and provides a positive visual indication that vacuum has been maintained in the container. In its preferred form, the maintenance of the vacuum is indicated not only visually, but also audibly upon the opening of the sealed container.

An additional safety feature provided in accordance with this invention is the presence of a novel gas venting means for controlling the amount of pressure in the container. With closures of the preferred embodiment of the present invention, the one-piece closure may be screwed down, as to its final tightness. The gas venting means is a one-way pressure relief mechanism and comprises a resilient sealing number overlying an orifice in the closure. The resilient sealing member is resilient enough to be stretched away from engagement with the orifice under excessive internal pressure to allow gases to be vented, as when the container is being heated, and so that when the internal pressure is relieved, the member will re-engage the orifice again to seal against the orifice, thereby to allow the container to produce and maintain an internal vacuum.

A package in accordance with this invention comprises a glass container having a body portion and an upwardly-extending threaded neck portion which terminates in a mouth which presents an upper circumferential sealing lip, and a one-piece closure sealingly secured to the container and provided with the aforementioned gas venting means. The closure also comprises a central cover section terminating outwardly in an integral depending peripheral flange or skirt having a thread in threaded engagement with the container thread. An annular gasket, preferably formed of a closed-cell foam material, is bonded to the closure adjacent the skirt, and is in sealing engagement with the lip around its entire peripheral edge. A portion of the central cover section is dished and is maintained in an inwardly dished configuration by subatmospheric pressure in the sealed package. When the closure is unscrewed to gain access to the contents of the container, the central cover portion springs preferentially to an outwardly dished configuration.

In one embodiment, the one-way pressure relief mechanism comprises a rectangular strip of flexible, resilient material disposed over a hole or orifice in the central cover section of the closure. The top surface of the closure is coated, except for an immediate area around the orifice, with a material to which the resilient material adheres. The strip is secured on each of its ends to the coating on the closure and is left unsecured in the middle immediately around the orifice. The middle portion of the strip is wide enough to extend completely over the orifice. Under pressure, the middle portion of the strip lifts off of the orifice to vent the gases from inside the container. When the pressure is relieved, the middle portion of the strip springs back to its original position in contact with, and sealing, the orifice.

In another embodiment, the top surface of the closure is coated, except for an immediate annular area around the orifice and except for a vent area extending radially outward from, and beyond, the annular area, with a material to which the resilient material adheres. A globule, blob, or mass, of resilient material is disposed over the orifice and beyond the annular area, but not beyond the vent area. The mass can be of irregular, elliptical, circular, or any other configuration and adheres to the coated portion of the closure but not to the uncoated annular area and vent area.

A method of home canning in accordance with this invention comprises the steps of filling a container with a desired quantity of product to be canned, threadingly securing a one-piece closure of this invention to the container with the gasket in sealing engagement with the container lip, and then, while heating the container, permitting gases present within the sealed container to break the seal between the resilient sealing member and the orifice by stretching the member away from the orifice so as to vent the gases to the surrounding atmosphere, and thereafter, while cooling the container, re-effecting the seal between the member and the orifice without further manipulation of the closure, thereby to allow a subatmospheric pressure or vacuum to develop in the container. The central cover section of the closure defines a normally outwardly dished central cover portion which is drawn into a downwardly dished configuration as the pressure within the container decreases below atmospheric pressure upon cooling, thereby visually indicating that the container contents are under a subatmospheric pressure.

Numerous other advantages and features of the present invention will become readily apparent from the following detailed description of the invention and of one embodiment thereof, from the claims and from the accompanying drawings in which each and every detail shown is fully and completely disclosed as part of this specification.

DESCRIPTION OF THE PREFERRED EMBODIMENT

Figure 1:
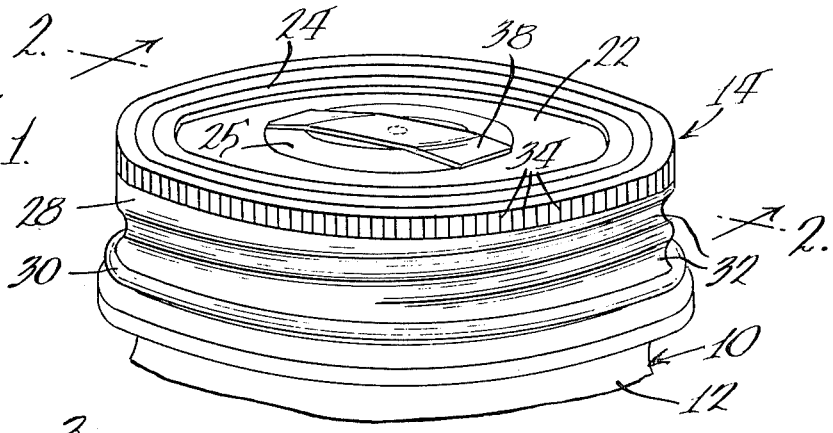
FIG. 1 is a fragmentary perspective view of a closure threaded on a glass jar container.

While this invention is susceptible of embodiment in many different forms, there is shown in the drawings and will herein be described in detail a preferred embodiment of the invention and modifications thereof, with the understanding that the present disclosure is to be considered as an exemplification of the principles of the invention and is not intended to limit the invention to the embodiments illustrated. The scope of the invention will be pointed out in the appended claims.

In the following description, two digit numerals are used to refer to the embodiment illustrated in FIGS 1–7 and three digit numerals in the one hundred series are used to refer to the embodiment illustrated in FIGS. 8–10. The same last two digits in each numeral designate similar or functionally analogous elements in the various embodiments.

Figure 2:
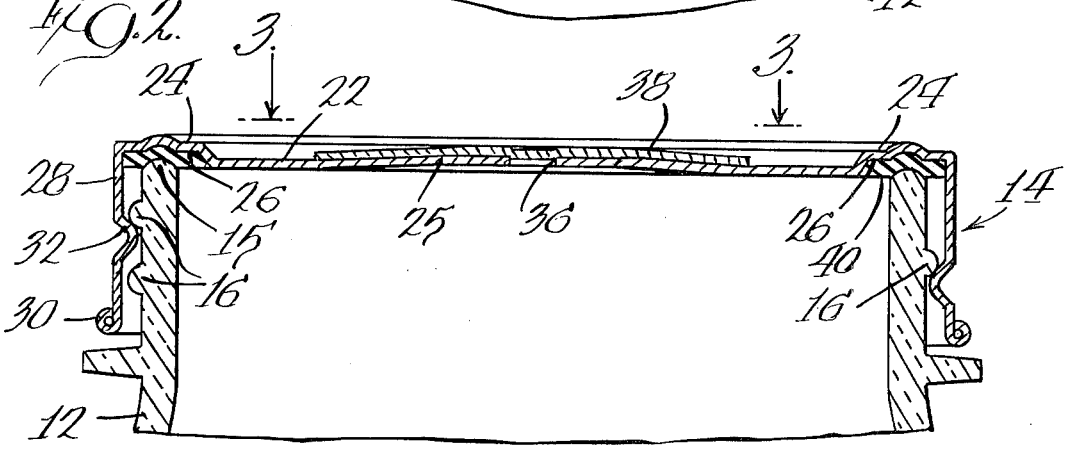
FIG. 2 is a cross-sectional view, taken along the plane 2—2 of FIG. 1, showing the closure and container top in sealingly threaded engagement with each other.
Figure 3:
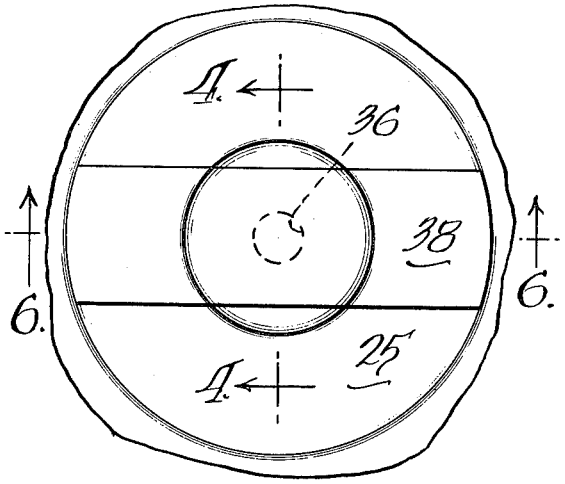
FIG. 3 is an enlarged partial plan view, taken along the plane 3—3 of FIG. 3.

Referring now to FIGS. 1 and 2 which illustrate a presently preferred embodiment of this invention, a package comprising glass container 12 proportioned to cooperate with one-piece reusable closure 14 of this invention is provided. Container 12 has a body portion and an upwardly-extending neck portion presenting a mouth surrounded by an upper, circumferential sealing bead or lip 15. Helical thread 16 adapted to engage with a complementary closure thread is provided on container 12 just below lip 15.

A one-piece reusable closure 14 of this invention is provided for closing the container mouth via a gasket which sealingly engages lip 15. Closure 14 may preferably be metallic, as of steel, tinplate or aluminum, and comprises central cover section 22 which is bounded by annular shoulder 24. Central cover section 22 defines domed central cover portion 25 which is outwardly dished. Under partial vacuum, domed central cover portion 25 is drawn into an upwardly dished configuration. When partial vacuum is relieved, domed central portion 25 preferentially springs back to the outwardly dished configuration of FIG. 3. Shoulder 24 borders an inverted, downwardly opening annular gasket receiving channel 26 which terminates at its outer edge in depending peripheral skirt 28. Rolled edge bead 30 is provided at the lower edge of skirt 28.

Depending skirt 28 is suitably formed to provide helical skirt thread 32 proportioned to threadingly engage container thread 16 of container 12. Although thread 32 is illustrated as a continuous thread, it will be apparent that a suitable segmental or interrupted thread of a known type can also be utilized.

The uppermost portion of depending skirt 28 may be formed with a plurality of corrugations 34 of conventional size and shape to facilitate gripping of the closure for securing it with, and for removing it from, container 12.

Channel 26 is filled with a suitable sealing material which serves as resilient gasket 40. The gasket material is preferably a foamed material of the closed-cell type, but may be a solid resilient material, such as natural rubber, since the gasket material is not relied upon for venting.

A preferred material for a foamed gasket is a polyvinyl chloride plastisol of the type described in U.S. Pat. No. 3,005,433. Such materials may be foamed, as by the addition of a suitable quantity of a gas generating material, such as a blowing agent sold by E. I. du Pont de Nemours Co. under the designation "Nitrosan." A suitable blowing agent may comprise a mixture of 70% N,N'-dimethyl-N,N'-dinitrosoterephthalamide and 30% white mineral oil, a mixture which liberates nitrogen gas at 100° C. Foamed plastisols of this type have previously been used for closures of different construction than those of the present invention, such as two-piece canning closures of the type referred to above and one-piece closures which are not intended for use as vacuum pack closures.

To provide a suitably bonded gasket, the metal closure is first coated with a suitable primer, following which the plastisol with the added blowing agent is applied, as in an annular pattern. Following its application, the plastisol is heated to expand and cure in situ and to form a strong, secure bond with the closure, thereby integrating it with the one-piece reusable closure of this invention. Suitably, the volume of plastisol used is expanded by the blowing agent by from about 10% to about 50% and preferably from about 20% to about 40%, thereby to provide a bonded foam gasket of closed-cell material which is resilient at elevated temperatures up to about 250° F. and suitable for use with the closure of this invention.

Figure 4:
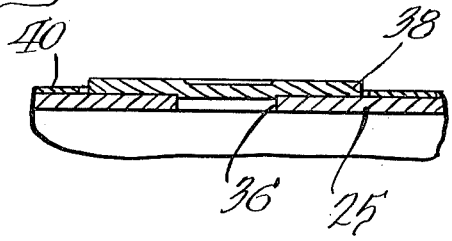
FIG. 4 is an enlarged cross-sectional view, taken along the plane 4—4 of FIG. 3.

A pressure relief means, comprising an orifice and sealing member, is provided in domed central portion 25 of closure 14. Orifice 36 is provided in the center of closure 14. An orifice sealing member, specifically a resilient membrane or strip of elastic material 38, is disposed over orifice 36 and secured on each of its ends to closure 14. The strip of elastic material 38 is of such composition that it does not adhere or bond to metallic surfaces such as steel, tinplate, or aluminum, of which closure 14 would conventionally be made. Illustrative of such compositions are the aforementioned plastisols, foamed and unfoamed. To this end, the top exterior surface of closure 14 is coated with a primer 40, to which strip 38 will adhere. In the enlarged views of FIGS. 4–7, the primer 40 is shown as applied to the exterior surface of domed central cover portion 25 of closure 14. As illustrated in FIGS. 4 and 6, primer 40 is coated on the exterior surface of central cover section 22 and on domed central cover portion 25 except for an immediate area around orifice 36. The uncoated surface of closure 14 in the region of domed central cover portion 25 extends beyond the sides of sealing strip 38. Thus, in the immediate area of orifice 36, sealing strip 38, being stretched under tension over orifice 36, lies on top of, and in contact with, the uncoated metallic surface of domed central cover portion 25 and does not stick to, or adhere to, the metal. However, the ends of orifice sealing strip 38 do lie above, and in contact with, coating primer 40 on closure 14 and do adhere or bond to closure 14 at those locations. As a result, the portion of orifice sealing strip 38 lying over orifice 36 is free of, and can be forced away from contact with, the edges of orifice 36 defined by domed central cover portion 25 when pressure is applied at orifice 36 from beneath closure 14.

Figure 5:
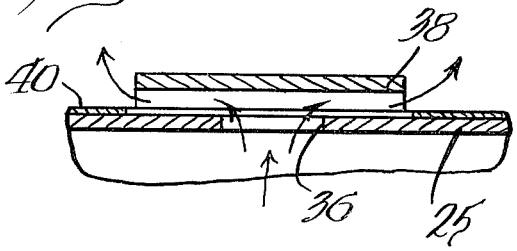
FIG. 5 is an enlarged cross-sectional view, similar to FIG. 4, showing gas venting through the closure orifice with the contents of the container under superatmospheric pressure.
Figure 6:
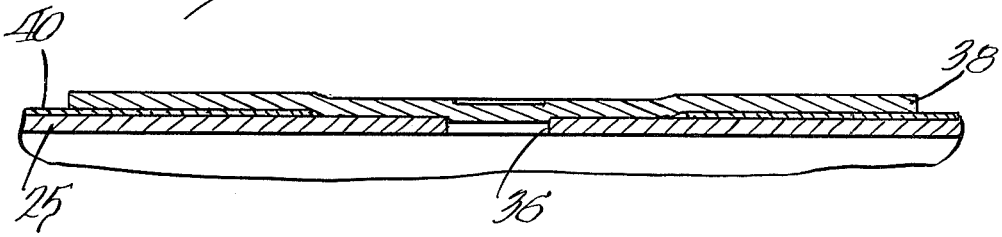
FIG. 6 is an enlarged cross-sectional view, taken along the plane 6—6 of FIG. 3.
Figure 7:
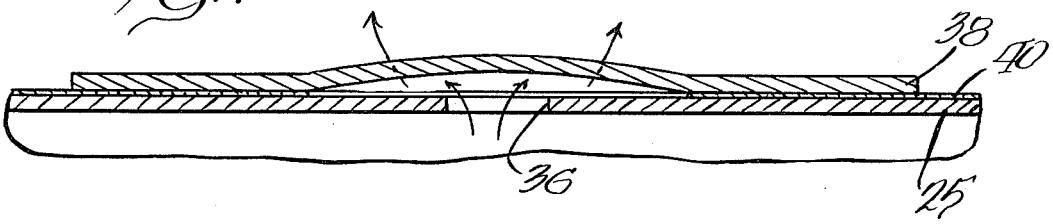
FIG. 7 is an enlarged cross-sectional view, similar to FIG. 6, showing gas venting through the closure orifice with the contents of the container under superatmospheric pressure.

As illustrated in FIGS. 5 and 7, gas pressure inside container 12 can act on the underside of closure 14 in the region of domed central cover portion 25 and in the region of orifice 36 to force orifice sealing strip 38 upwardly, and away from, closure 14 to provide a vent path for the gas to escape.

When closure 14 is to be sealingly secured to container 10, thereby to seal the contents of the container therewithin, the container is first filled with foodstuff as desired. Closure 14 is then juxtaposed with the mouth of container 12 and is then screwed down, as illustrated by FIGS. 1 and 2, until gasket 40 sealingly engages lip 15 around the entire lip. When closure 14 has been sufficiently tightened, the contents of container 12 are heated to safeguard them against spoilage. As the internal pressure increases, it reaches a level at which it acts against resilient orifice sealing strip 38, as illustrated by FIGS. 5 and 7, thereby breaking the seal to vent gases, and to allow the gases to escape from the container to the surrounding atmosphere.

After heating has been completed and is discontinued, the internally developed container pressure decreases as the container cools. As this occurs, sealing strip 38 will again engage orifice 36 re-effecting the seal over orifice 36, without further manipulation of the closure. As further cooling occurs, a partial vacuum is developed in the container. When a partial vacuum of approximately two to four inches of water is reached, outwardly domed central cover portion 25 is pulled inwardly to an inverted domed position. The movement of domed central cover portion 25 from the outwardly dished position to the inwardly dished position is accompanied by an audible click-type sound. As long as subatmospheric pressure, i.e., partial vacuum, is maintained within the container, domed central cover portion 25 will remain in the inverted, domed or dished position, thereby providing a visual indication that the formed seal is maintained. When the closure is unscrewed to gain access to the contents of the package, gasket 40 will be moved away from its sealing engagement with lip 14. That will permit air to enter the container, equilibrating internal pressure with that of the ambient atmosphere, and will then permit central cover portion 25 to return to the up-position of FIG. 2. Of course, if container 12 is removed from storage and closure 14 is found to be domed upwardly, that condition serves as a visual indication that the contents may be spoiled and should not be used.

With respect to the current two-piece closures, it is to be observed that when the contents of a sealed container are to be used and the container is to be opened, the peripheral closure portion must first be unscrewed and removed. That leaves the gasketed central section in sealing engagement with the container. An implement must then be used to pry up the panel, thereby to break the seal with the gasket. This usually damages or destroys the gasket, making the cover panel non-reusable. The closure of this invention is removable as a unit simply by unscrewing it, without extraneous implements and without damage to the gasket, thereby making it reusable.

Figure 8:
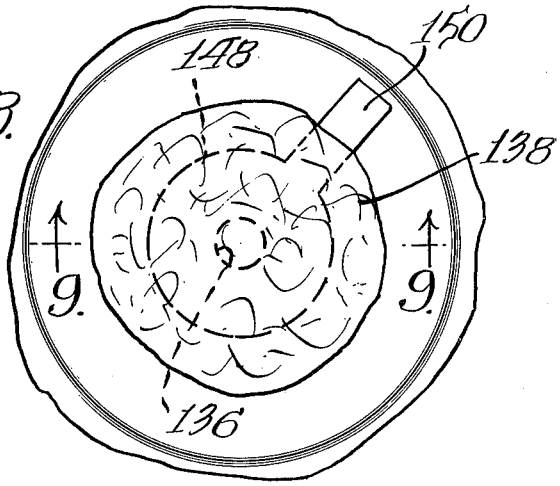
FIG. 8 is a partial plan view of another embodiment of this invention showing a mass of resilient material disposed over an orifice in a closure.
Figure 9:
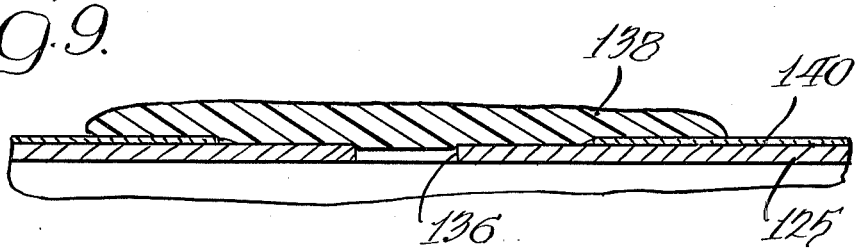
FIG. 9 is an enlarged cross-sectional view, taken along the plane 9—9 of FIG. 8.
Figure 10:
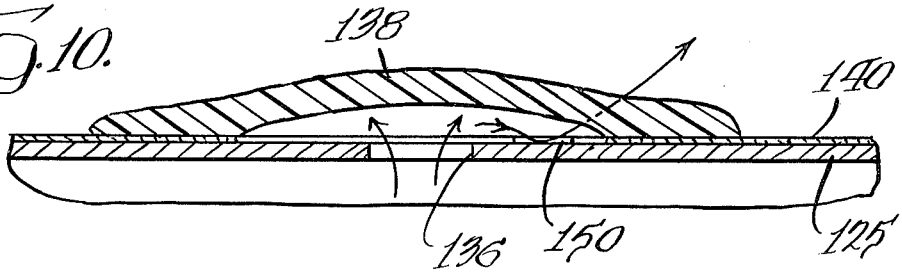
FIG. 10 is an enlarged cross-sectional view, similar to FIG. 9, showing gas venting through the closure orifice with the contents of the container under superatmospheric pressure.

Another embodiment of this invention is shown in FIGS. 8–10. Here the sealing member of the preferred embodiment described above is in the form of a blob or mass 138 of resilient material which is applied to domed central cover portion 125 of a closure over orifice 136. The top exterior surface of the closure, including domed central cover portion 125, except for an immediate annular area 148 around the orifice 136 and a vent area 150, is coated with primer 140 to which resilient mass 138 adheres. Resilient mass 138 does adhere or bond to the uncoated, bare metal of domed central cover portion 125. Resilient mass 138 extends over, and beyond, annular area 148 and adheringly contacts the surrounding primer 140. A portion of uncoated vent area 150 extends beyond mass 138. Thus, when internal container pressure is exerted at orifice 136, resilient mass 138 is forced upwardly, and away from, sealing contact with annular area 148 and vent area 150 to provide a path for container gases to vent to atmosphere.

It will be apparent that the one-piece closure of this invention provides a number of advantages. Although but a few embodiments have been illustrated, those skilled in the art will appreciate that the closure and the method of using it may take a variety of forms. Accordingly, I intend to be limited only insofar as the appended claims shall require.

I claim:

1. A sealed package under vacuum comprising a container having a body portion and an upwardly-extending neck portion which terminates in an upper circumferential sealing lip and defines a mouth; helical container thread means on the outer surface of said neck portion; and a one-piece reusable closure threadedly engaging said neck portion and sealingly secured to said container; said closure comprising a central cover section having an inner surface and an outer surface and terminating outwardly in a depending peripheral skirt having a helical skirt thread means complementary to and in threaded engagement with said container thread means, a downwardly opening annular channel being defined in said central cover section adjacent said skirt, a resilient annular gasket disposed in, and bonded to, the inner surface of said annular channel and being in sealing engagement with said lip around the entire periphery of said lip, a portion of said central cover section presenting a substantially flat exterior surface defining an orifice and having a self-biased resilient member secured to said central cover section for disengageably overlying said orifice and normally sealing said orifice but venting said package when the pressure within said container exceeds atmospheric, a portion of said closure central cover section being inwardly dished and being maintained in that inwardly dished configuration when pressure within the sealed package is subatmospheric, said inwardly-dished portion being capable of springing preferentially to an outwardly dished configuration when the pressure within the sealed package is at least atmospheric.

2. The sealed package in accordance with claim 1 wherein said resilient member is a resilient membrane.

3. A sealed package in accordance with claim 2 wherein said resilient membrane is a strip of elastic material positioned over said orifice and secured to said central cover section under tension.

4. A sealed package in accordance with claim 1 wherein said resilient member is a glob-like mass of resilient material.

5. A one-piece reusable closure for a container having a body portion and an upwardly extending neck portion having helical container thread means on the outer surface thereof and terminating in an upper circumferential sealing lip which defines a mouth, said closure comprising:

a central cover section having an inner surface and an outer surface and a depending peripheral skirt having helical skirt thread means for threadingly engaging the container thread of a container; an annular gasket at the periphery of said central cover section, said gasket being bonded to said central cover section for confronting the periphery of said sealing lip;

a portion of said central cover section presenting a substantially flat exterior surface defining an orifice and havng a self-biased resilient member attached to said central cover section for disengageably overlying said orifice and normally sealing said orifice but opening said orifice to limit the pressure differential across the closure when the greater pressure is on said inner surface thereby venting said container when the pressure within said container exceeds atmospheric; and a portion of said central cover section being outwardly dished, but being movable under partial vacuum drawn against its inner surface to an inwardly dished configuration and capable of generating an audible sound upon movement.

6. The one-piece reusable closure in accordance with claim 5 wherein said resilient member is a resilient membrane.

7. The one-piece reusable closure in accordance with claim 6 wherein said resilient membrane is a strip of elastic material positioned over said orifice and secured on each end to said central cover section under tension.

8. The one-piece reusable closure in accordance with claim 5 wherein said resilient member is a glob-like mass of resilient material.

9. A sealed package under vacuum comprising a container having a body portion and an upwardly-extending neck portion which terminates in an upper circumferential sealing lip and defines a mouth; helical container thread means on the outer surface of said neck portion; and a one-piece reusable closure threadedly engaging said neck portion and sealingly secured to said container; said closure comprising a central cover section having an inner surface and an outer surface and terminating outwardly in a depending peripheral skirt having a helical skirt thread means complementary to and in threaded engagement with said container thread means, a downwardly opening annular channel being defined in said central cover section adjacent said skirt, a resilient annular gasket disposed in, and bonded to, the inner surface of said annular channel and being in sealing engagement with said lip around the entire periphery of said lip, a portion of said central cover section defining an orifice and having a mass of resilient material secured to said central cover section disengageably overlying said orifice and normally sealing said orifice but venting said package when the pressure within said container exceeds atmospheric, a coating of primer on said exterior surface of said central cover section except for an immediate area around said orifice, a vent area connected with, and extending outwardly from, said immediate area, said mass of resilient material covering, and extending beyond, said immediate area and being bonded to said primer beyond the outer periphery of said immediate area, a portion of said closure central cover section being inwardly dished and being maintained in that inwardly dished configuration when pressure within said sealed package is subatmospheric, said inwardly-dished portion being capable of springing preferentially to an outwardly dished configuration when the pressure within the sealed package is at least atmospheric.

10. The sealed package in accordance with claim 9 wherein said immediate area is of annular configuration.

11. A one-piece reusable closure for a container having a body portion and an upwardly extending neck portion having helical container thread means on the outer surface thereof and terminating in an upper circumferential sealing lip which defines a mouth, said closure comprising:

a central cover section having an inner surface and an outer surface and a depending peripheral skirt having helical skirt thread means for threadingly engaging the container thread of a container; an annular gasket at the periphery of said central cover section, said gasket being bonded to said central cover section for confronting the periphery of said sealing lip; a portion of said central cover section defining an orifice and having a mass of resilient material secured to said central cover section for disengageably overlying said orifice and normally sealing said orifice but opening said orifice to limit the pressure differential across the closure when the greater pressure is on said inner surface thereby venting said container when the pressure within said container exceeds atmospheric; an exterior coating of primer on said exterior surface of said central cover section except for an immediate area around said orifice, a vent area connected with, and extending outwardly from, said immediate area, said mass of resilient material covering, and extending beyond, said immediate area and being bonded to said primer beyond the outer periphery of said immediate area; and a portion of said central cover section being outwardly dished, but being movable under partial vacuum drawn against its inner surface, to an inwardly dished configuration and capable of generating an audible sound upon movement.

12. The one-piece reusable closure in accordance with claim 11 wherein said immediate area is of annular configuration.

13. A method of canning comprising the steps of:

providing a container having an upper circumferential sealing lip which defines a mouth and having container thread means in the vicinity of the mouth; providing a one-piece closure comprising a flexible, outwardly-dished central cover section terminating outwardly in a depending peripheral threaded skirt for threadingly engaging said container thread means, said closure having an annular gasket bonded to said closure adjacent said skirt, said gasket comprising resilient material for sealingly engaging said lip around the periphery of the entire lip, a portion of said central cover section defining a substantially flat exterior surface defining an orifice and having a self-biased resilient member attached to said central cover section for disengageably overlying said orifice, said member being deformable away from said orifice for venting said package when the pressure within said container exceeds atmospheric and being self-biased against said orifice for normally sealing thereagainst when the pressure within said container is less than atmospheric; filling the container with a desired quantity of product to be canned; threadingly securing said one-piece closure to said container to form a seal between said gasket and said lip and to thereby seal said product within said container together with a small volume of gas; then heating said container and said product contained therein to a predetermined elevated temperature and thereby generating within the sealed container pressure sufficient to deform said resilient member and vent at least a portion of volume of gas through said orifice to the surrounding atmosphere; then cooling said container and thereby re-effecting the sealing of said orifice by said resilient member without further manipulation of said closure so as to maintain a sub-atmospheric pressure in said container.

14. A method in accordance with claim 13 which includes drawing said central cover portion into a downwardly dished configuration while developing a partial vacuum in said container.

15. A method in accordance with claim 13 in which said one-piece closure is one which has previously been used to seal a container.

* * * * *